US008649699B2

(12) United States Patent
Kajita

(10) Patent No.: US 8,649,699 B2
(45) Date of Patent: Feb. 11, 2014

(54) FIXING DEVICE

(75) Inventor: Masahito Kajita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 238 days.

(21) Appl. No.: 13/040,825

(22) Filed: Mar. 4, 2011

(65) Prior Publication Data

US 2011/0229229 A1 Sep. 22, 2011

(30) Foreign Application Priority Data

Mar. 17, 2010 (JP) ..... 2010-061090

(51) Int. Cl.
*G03G 15/00* (2006.01)
*G03G 15/20* (2006.01)

(52) U.S. Cl.
USPC ..... 399/90; 399/330

(58) Field of Classification Search
USPC ..... 399/88, 90, 330
See application file for complete search history.

(56) References Cited

U.S. PATENT DOCUMENTS

| | | | | |
|---|---|---|---|---|
| 6,275,669 | B1 | 8/2001 | Hasegawa | |
| 6,463,251 | B2 * | 10/2002 | Kiuchi | 399/330 |
| 7,113,722 | B2 * | 9/2006 | Chung et al. | 399/90 |
| 7,369,806 | B2 | 5/2008 | Tomatsu et al. | |
| 7,653,338 | B2 * | 1/2010 | Kim et al. | 399/330 |
| 2005/0084279 | A1 * | 4/2005 | Cho et al. | 399/90 |
| 2006/0024098 | A1 | 2/2006 | Tomatsu et al. | |
| 2006/0140690 | A1 * | 6/2006 | Ito et al. | 399/330 |

FOREIGN PATENT DOCUMENTS

| | | | |
|---|---|---|---|
| JP | 8044233 | A | 2/1996 |
| JP | 2000-284622 | | 10/2000 |
| JP | 2001-154522 | | 6/2001 |
| JP | 2006039433 | A | 2/2006 |
| JP | 2009-180839 | | 8/2009 |
| JP | 2009-229849 | | 10/2009 |
| JP | 2009-295462 | * | 12/2009 |

OTHER PUBLICATIONS

Office Action for Japanese patent application No. 2010-061090 mailed Feb. 7, 2012.

* cited by examiner

*Primary Examiner* — Sandra Brase
(74) *Attorney, Agent, or Firm* — Banner & Witcoff, Ltd.

(57) ABSTRACT

A heater is inserted into a roller through-hole of a heating roller body. An attached portion of a terminal plate is attached to a power supply terminal provided on one end of the heater. An engaging portion is a plate member extending from the attached portion in a first radial direction of the heating roller body and arranged in parallel with a longitudinal direction of the heater. The engaging portion is engaged with the fixing frame. An engaging terminal portion is a plate member extending from the attached portion in a second radial direction of the heating roller body and intersects with the longitudinal direction of the heater. The second radial direction is a direction the same as the first radial direction.

6 Claims, 10 Drawing Sheets

FIXING DEVICE

CROSS REFERENCE TO RELATED APPLICATION

This application claims priority from Japanese Patent Application No. 2010-061090 filed Mar. 17, 2010. The entire content of the priority application is incorporated herein by reference.

TECHNICAL FIELD

The present invention relates to a fixing device configured to convey a sheet-type recording medium in a sheet conveying direction that is perpendicular to a widthwise direction of the recording medium and to thermally fix a developer image formed on the recording medium to the recording medium.

BACKGROUND

An image forming device for forming a developer (toner) image (hereinafter referred to as "toner image") on a sheet-type recording medium (sheet) includes a fixing device. It has been well known that such a fixing device is provided with a heating roller and a pressure roller.

The heating roller includes a hollow tubular member made of metal that has an inner peripheral surface defining an internal space, and a heater that is disposed in the internal space. A halogen heater is widely used as the heater. The pressure roller is arranged juxtaposed with the heating roller so as to be pressed toward the heating roller. In such a fixing device, a sheet on which a toner image is formed is heated and pressed by the pressure roller and the heating roller to fix the toner image onto the sheet while conveyed in the sheet conveying direction.

In such a fixing device, in order to stably support the heater as well as stably supply electric power to the heater, the hollow tubular member is rotationally driven, while the heater is fixedly (non-rotatably) supported to a frame of the fixing device. Such a fixing device is disclosed in Japanese Patent Application Publication No. 2000-284622.

In the above described fixing device, the heater has a power supply terminal fixed to each of widthwise end portions thereof in a longitudinal direction, and a metal terminal plate fixed to the power supply terminal. The terminal plate is fixed to the frame of the fixing device and electrically connected to a cable for supplying electric power to the heater. In the Japanese Patent Application Publication No. 2000-284622, the terminal plate is fixed to the frame by soldering.

It has been proposed that, in order to reliably and easily connect the terminal plate to the cable electrically, the cable has a distal end provided with a connector (for example, a faston connector), and the connector is resiliently engaged with the terminal plate. Such a configuration is disclosed in Japanese Patent Application Publication Nos. 2009-180839, 2009-229849, and 2009-295462.

SUMMARY

In order to downsize an image forming device, a compact fixing device is required. It is not preferable for this type of fixing device to have large sized parts and components. Further, the heating roller is required to have a small diameter for lowering power consumption, including reduction of a warm-up time. Thus, in the fixing device, compact parts and components are desired for various reasons.

In view of the foregoing, it is an object of the present invention to provide a fixing device that can stably support a heater, reliably supply electric power to the heater, and be provided with more compact parts and components.

In order to attain the above and other objects, the present invention provides a fixing device including a heating roller body, a heater, a power supply terminal, a terminal plate, and a fixing frame. The heating roller body is a cylindrical member configured to be capable of rotating about a first axis and extending a first axial direction. The heating roller body is formed with a roller through-hole extending in the first axial direction. The heater is inserted into the roller through-hole and is configured to generate a heat. The heater extends in a longitudinal direction in parallel with the first axial direction and has one end in the longitudinal direction. The power supply terminal is fixed to the one end. The terminal plate is attached to the power supply terminal to supply electric power to the heater. The fixing frame rotatably supports the heating roller body and fixedly supports the heater. The terminal plate includes an attached portion, an engaging portion, and an engaging terminal portion. The attached portion is attached to the power supply terminal. The engaging portion is a plate member extending from the attached portion in a first radial direction of the heating roller body and arranged in parallel with the longitudinal direction. The engaging portion is engaged with the fixing frame. The engaging terminal portion is a plate member extending from the attached portion in a second radial direction of the heating roller body and intersects with the longitudinal direction of the heater. The second radial direction is a direction the same as the first radial direction. The engaging terminal portion is inserted into a connector connected to an end portion of a cable for supplying the electric power to the heater.

BRIEF DESCRIPTION OF THE DRAWINGS

The particular features and advantages of the invention as well as other objects will become apparent from the following description taken in connection with the accompanying drawings, in which.

DETAILED DESCRIPTION

A laser printer as an image forming device according to one embodiment of the present invention will be described while referring to FIG. 1.

<General Structure of Laser Printer>

Figure 1:
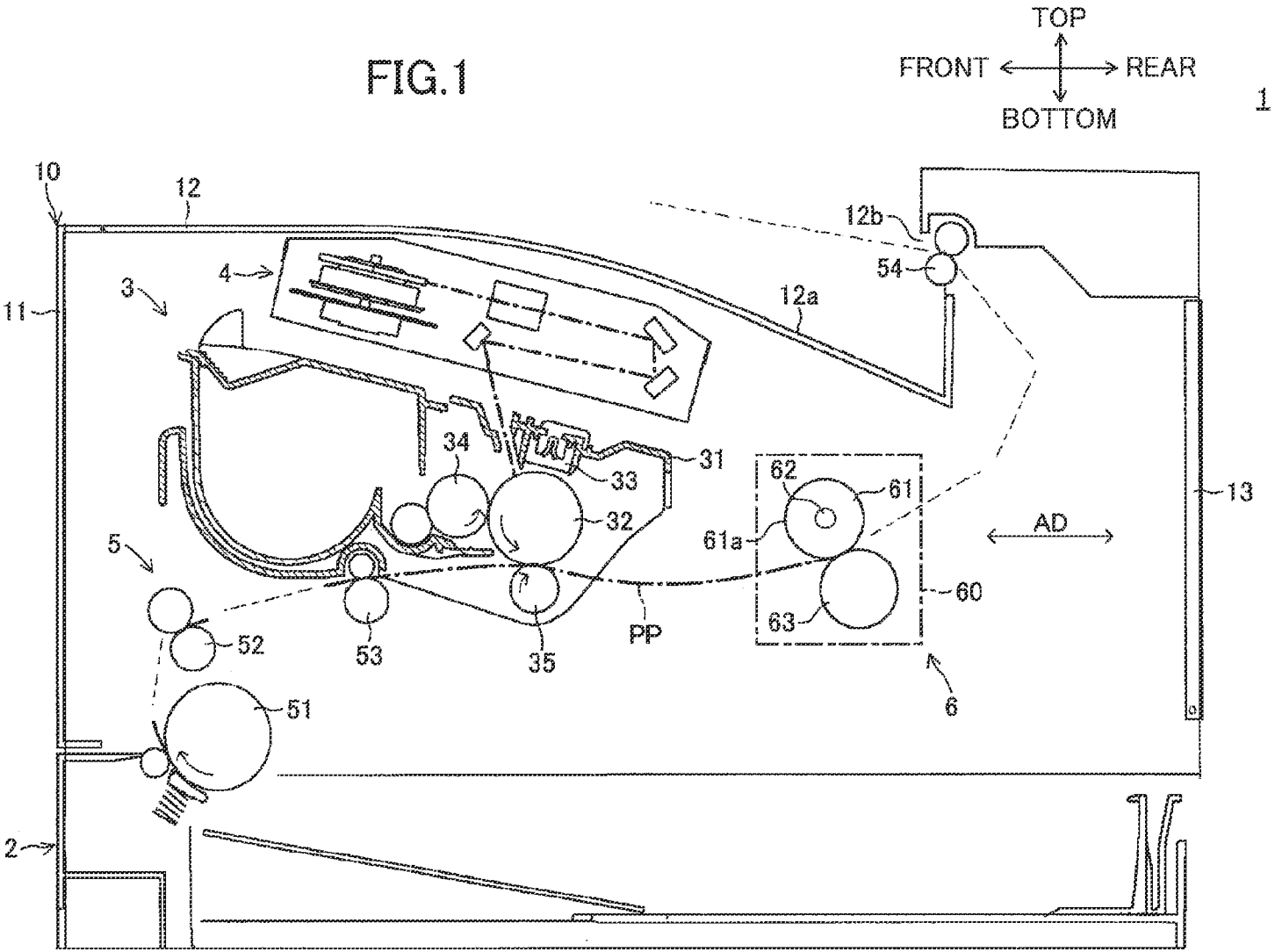
FIG. 1 is a schematic cross-sectional view showing a structure of a laser printer as an image forming device according to an embodiment of the present invention.

As shown in FIG. 1, the laser printer 1 is configured to convey a sheet type recording medium (sheet) along a paper conveying path PP defined therein to form a developer (toner) image (hereinafter referred to as "toner image") on the sheet. The laser printer 1 is provided with a main body 10, and within the main body 10, a feeder unit 2, a process cartridge 3, a scanner unit 4, a sheet conveying section 5, and a fixing unit 6 are provided.

Throughout the specification, the terms "above", "below", "right", "left", "front", "rear" and the like will be used throughout the description assuming that the laser printer 1 is disposed in an orientation in which it is intended to be used. More specifically, a left side and a right side in FIG. 1 are a front side and a rear side, respectively. Further, in FIG. 1, a direction of a sheet to be conveyed along the paper conveying path PP, that is, a tangential direction of the sheet at a given position in the paper conveying path PP will be referred to as a sheet conveying direction. Further, in FIG. 1, a widthwise direction of the laser printer 1 that is perpendicular to a frontward/rearward direction and a vertical direction (a height direction of the laser printer 1) will be referred to as a sheet width direction. Incidentally, the sheet width direction is perpendicular to the sheet conveying direction and a sheet thickness direction.

The feeder unit 2 is disposed at a lower portion of the main body 10. The feeder unit 2 is slidably movable in the frontward/rearward direction, and detachable from or attachable to the main body 10. The feeder unit 2 is configured to accommodate a stack of sheets of paper therein.

The process cartridge 3 is detachably mounted in the main body 10. The process cartridge 3 is configured such that a toner image is borne on the sheet in cooperation with the scanner unit 4. The sheet conveying section 5 for conveying the sheet along the paper conveying path PP and the fixing unit 6 for thermally fixing a toner image formed on a sheet by the process cartridge 3 are provided in the main body 10. In the present embodiment, the fixing unit 6 is disposed at a rear portion of the main body 10, and is detachable or attachable relative to the main body 10.

Each part and component of the laser printer 1 according to the present embodiment will next be described.

<Main Body>

The main body 10 includes an outer cover 11, a top cover 12, and a rear cover 13. The outer cover 11 serves as a casing of the main body 10. The outer cover 11 is formed substantially in a box shape and made of synthetic resin. The outer cover 11 is provided to cover a main frame (not shown) for supporting various members accommodated in the main body 10.

The top cover 12 constitutes a top panel of the outer cover 11. The top cover 12 is formed with a recessed portion having a depth gradually increasing toward the rear side. The top cover 12 is provided with a discharge tray 12*a* defined by a bottom surface of the recessed portion. The discharge tray 12*a* is configured so as to form a slant surface extending diagonally below and rearward toward the rear side of the top cover 12 from the front side of the top cover 12. A discharge port 12*b* is formed in the outer cover 11 and disposed above a rear end of the discharge tray 12*a*. The discharge port 12*b* is formed in a generally rectangular-shape extending in the sheet width direction. Hence, a sheet on which an image has been formed is discharged from the discharge port 12*b*, and stacked on the discharge tray 12*a*.

The rear cover 13 is provided at the rear side of the outer cover 11. The rear cover 13 is movable between an open position and a closed position. That is, the rear cover 13 can be moved to the open position so as to open the rear side of the outer cover 11. A user can remove the fixing unit 6 from the main body 10 through the opening formed in the rear side of the outer cover 11, or clear a jammed sheet therethrough when a paper jam occurs in the fixing unit 6.

<Image Forming Section>

A process casing 31 constitutes a casing and a frame of the process cartridge 3. The process casing 31 accommodates toner as a dry powder type developer therein. The process casing 31 is provided with a photosensitive drum 32, a charger 33, a developing roller 34, and a transfer roller 35. The photosensitive drum 32 includes a cylindrical drum body and a photosensitive layer formed on an outer circumferential surface of the drum body. The photosensitive drum 32 has a shaft extending in a direction parallel with the sheet width direction, and is rotationally driven by a motor (not shown) about the shaft. The charger 33 opposes the outer circumferential surface of the photosensitive drum 32 to uniformly charge the photosensitive layer formed thereon.

The developing roller 34 is juxtaposed with the photosensitive drum 32 in the frontward/rearward direction. The developing roller 34 opposes the outer circumferential surface of the photosensitive drum 32. The developing roller 34 is positioned downstream of a position at which the charger 33 opposes the outer circumferential surface of the photosensitive drum 32 in a rotational direction of the photosensitive drum 32. The developing roller 34 is rotationally driven by a motor (not shown) to supply charged toner to the outer circumferential surface of the photosensitive drum 32.

The transfer roller 35 is disposed downstream of the position at which the developing roller 34 opposes the outer circumferential surface of the photosensitive drum 32 in the rotational direction, and opposes the outer circumferential surface of the photosensitive drum 32 interposing the paper conveying path PP therebetween. The transfer roller 35 rotates in a direction accompanied by the photosensitive drum 32, that is, a direction opposite to the rotational direction of the photosensitive drum 32. Further, the transfer roller 35 transfers a toner image formed on the outer circumferential surface of the photosensitive drum 32 on the sheet by a predetermined voltage applied between the transfer roller 35 and the photosensitive drum 32.

The scanner unit 4 is disposed above the process cartridge 3. The scanner unit 4 generates a laser beam modulated based on image data, and the outer circumferential surface of the photosensitive drum 32 that has been uniformly charged by the charger 33 is subjected to scan of the laser beam. The scanner unit 4 thus forms an electrostatic latent image on the outer circumferential surface of the photosensitive drum 32.

<Sheet Supply Section>

The sheet conveying section 5 includes a pair of sheet supply rollers 51, a pair of conveying rollers 52, a pair of registration rollers 53, and a pair of discharge rollers 54. The sheet conveying section 5 is configured to convey the sheet along the paper conveying path PP to the discharge tray 12*a* from the feeder unit 2.

The pair of sheet supply rollers 51 is disposed at a lower portion of the main body 10, and rotatably supported to the outer cover 11. The pair of sheet supply rollers 51 is positioned so as to contact leading edges of the sheets stacked in the feeder unit 2. The pair of sheet supply roller 51 is rotationally driven by a motor (not shown) so that each of the sheets stacked in the feeder unit 2 is picked up to be conveyed toward the conveying roller 52.

The pair of conveying rollers 52 is positioned downstream of the sheet supply rollers 51 in the sheet conveying direction. The pair of conveying rollers 52 conveys the sheet picked up by the pair of sheet supply rollers 51 toward the pair of registration rollers 53. The pair of registration rollers 53 is positioned upstream of a transfer position (a position at which the photosensitive drum 32 opposes the transfer roller 35) in the sheet conveying direction. The pair of registration rollers 53 adjusts an orientation of the sheet and conveying timing of the sheet. Further, the pair of registration rollers 53 supplies the sheet to the transfer position. The pair of discharge rollers 54 is disposed in the vicinity of the discharge port 12*b*, so that the sheet past the fixing unit 6 can be discharged onto the discharge tray 12*a*.

<General Structure of Fixing Unit>

The fixing unit 6 is positioned downstream of the transfer position in the sheet conveying direction. The fixing unit 6 is detachable or attachable relative to the main body 10, and movable in an attachment/detachment direction AD along the frontward/rearward direction. The fixing unit 6 includes a fixing frame 60, a heating roller body 61, a heater 62, and an opposing roller 63.

The heating roller body 61 extends in a direction parallel to the sheet width direction. The heating roller body 61 is a hollow thin cylindrical member made of metal. The heating roller body 61 is rotatably supported to the fixing frame 60 about an axis parallel to the sheet width direction. The heating roller 61 is formed with a roller through-hole 61*b* extending in an axial direction of the heating roller 61. The heating roller body 61 has widthwise open ends and a circumferential surface 61*a* opposing the paper conveying path PP.

The heater 62 is disposed in an internal space of the heating roller body 61. In the present embodiment, the heater 62 is a halogen lamp extending in the sheet width direction (an axial direction of the heating roller body 61). Electric power is supplied to the heater 62 by a power supply circuit (not shown), so that the heater 62 can generates heat necessary to heat the sheet and toner. Further, as described later, the heater 62 is fixedly supported to the fixing frame 60, that is, the heater 62 is not rotatable.

The opposing roller (pressure roller) 63 is arranged parallel to the heating roller body 61. The opposing roller 63 has an outer layer made of silicon rubber. The opposing roller 63 is provided at a position opposing the heating roller body 61 while interposing the paper conveying path PP therebetween. Hence the opposing roller 63 presses the heating roller body 61 at a predetermined pressure. That is, the fixing unit 6 is configured to nip the sheet on which a toner image is formed between the heating roller body 61 and the opposing roller 63 to heat and press the same so as to thermally fix the toner image onto the sheet.

Figure 2:
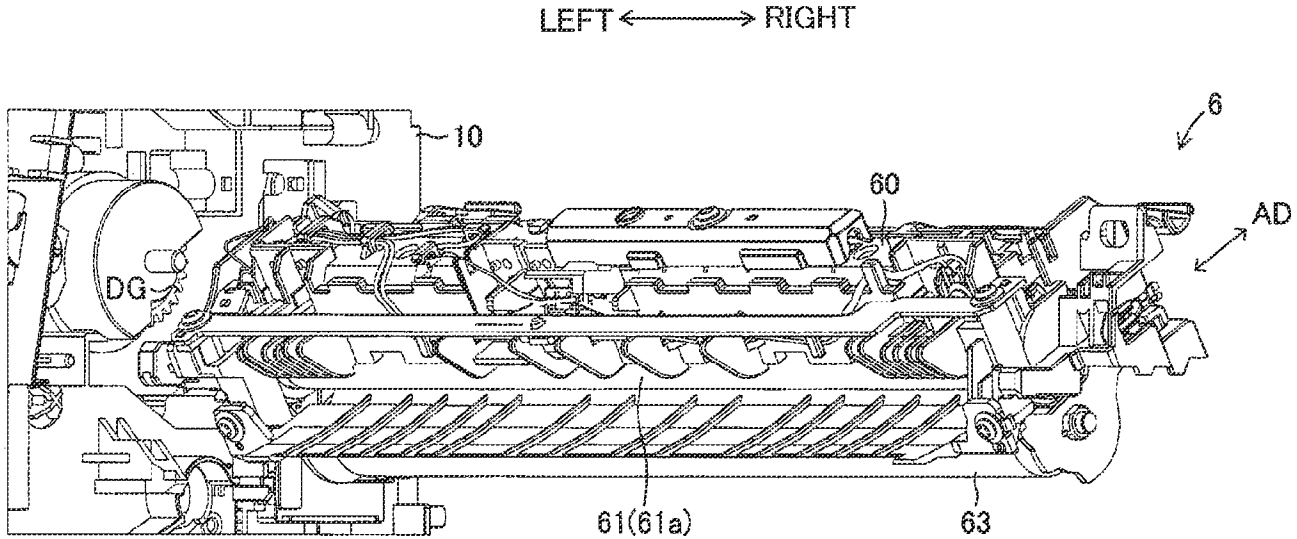
FIG. 2 is a perspective view of a fixing unit as viewed from an upper right front side of the laser printer according to the embodiment.
Figure 3:
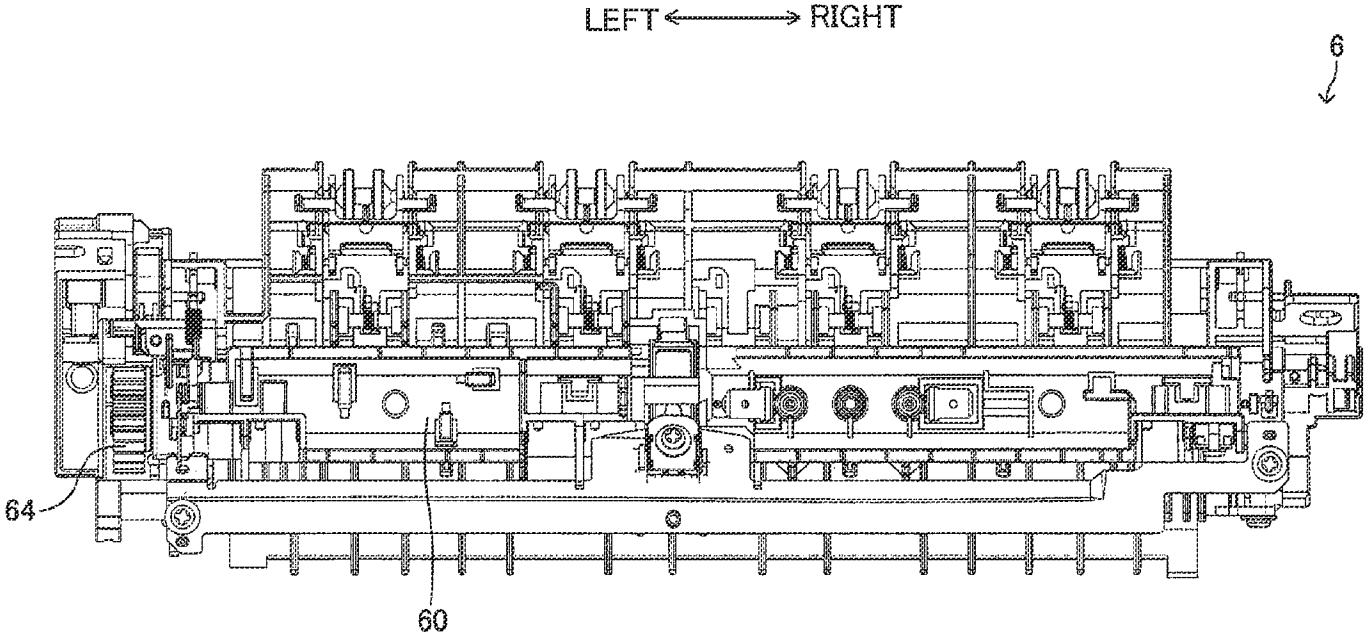
FIG. 3 is a plan view of the fixing unit shown in FIG. 2.
Figure 4:
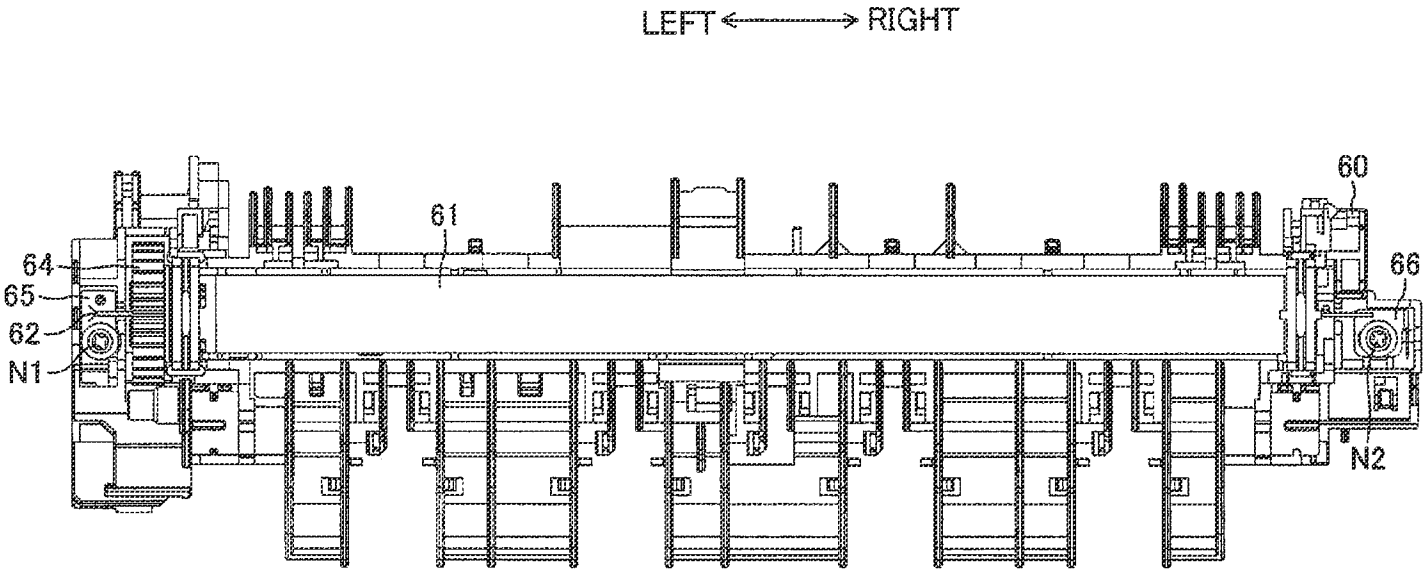
FIG. 4 is a partial exploded bottom view of the fixing unit shown in FIG. 2 as viewed from a heating roller body side.

As shown in FIGS. 2 through 4, a driven gear 64 is fixed to one of the widthwise open ends of the heating roller body 61 (left end). The driven gear 64 is meshedly engaged with a drive gear DG (shown in FIG. 2) provided in the main body 10 when the fixing unit 6 is mounted in the main body 10. The driven gear 64 is rotated by a drive force from the drive gear DG provided in the main body 10, thereby rotationally driving the heating roller body 61. The circumferential surface 61*a* of the heating roller body 61 is moved in the sheet conveying direction together with the sheet, while contacting a surface of the sheet on which a toner image is formed.

As shown in FIG. 4, the heater 62 has widthwise end portions. One of the widthwise end portions (left end portion) is fixed to the fixing frame 60 via a first terminal plate 65, while remaining one of the widthwise end portions (right end portion) is engaged with the fixing frame 60 via a second terminal plate 66. The first terminal plate 65 is fixed to the fixing frame 60 via a first screw N1, and not movable relative to the fixing frame 60. The second terminal plate 66 is engaged with the fixing frame 60 via a second screw N2, and movable relative to the fixing frame 60 in a longitudinal direction of the heater 62.

<Detailed Structure of Fixing Unit>

Figure 5:
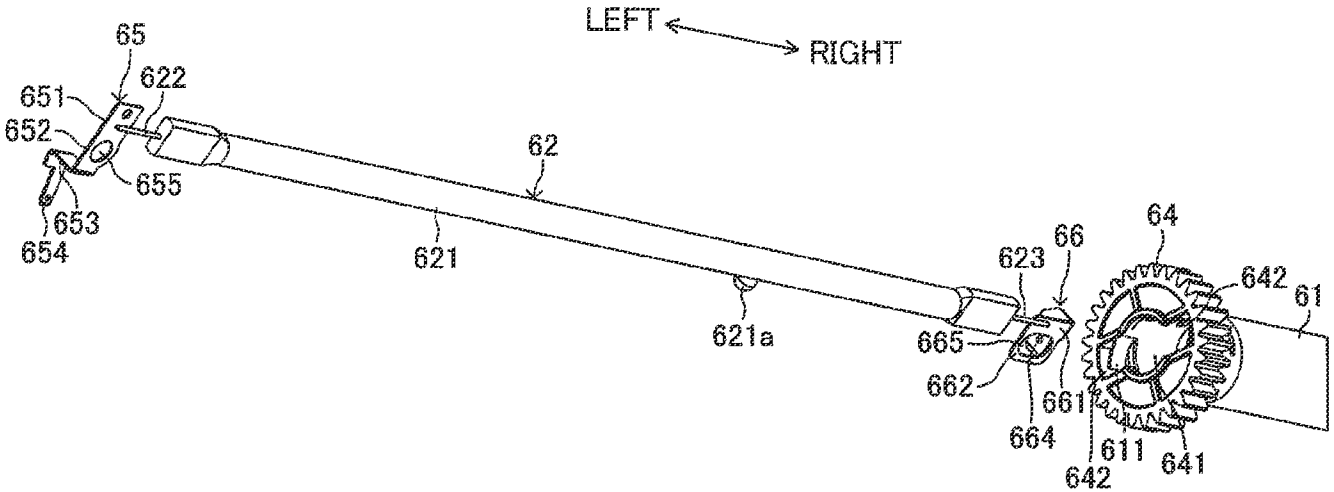
FIG. 5 is an exploded perspective view of the heating roller body and a heater shown in FIG. 4.
Figure 6:
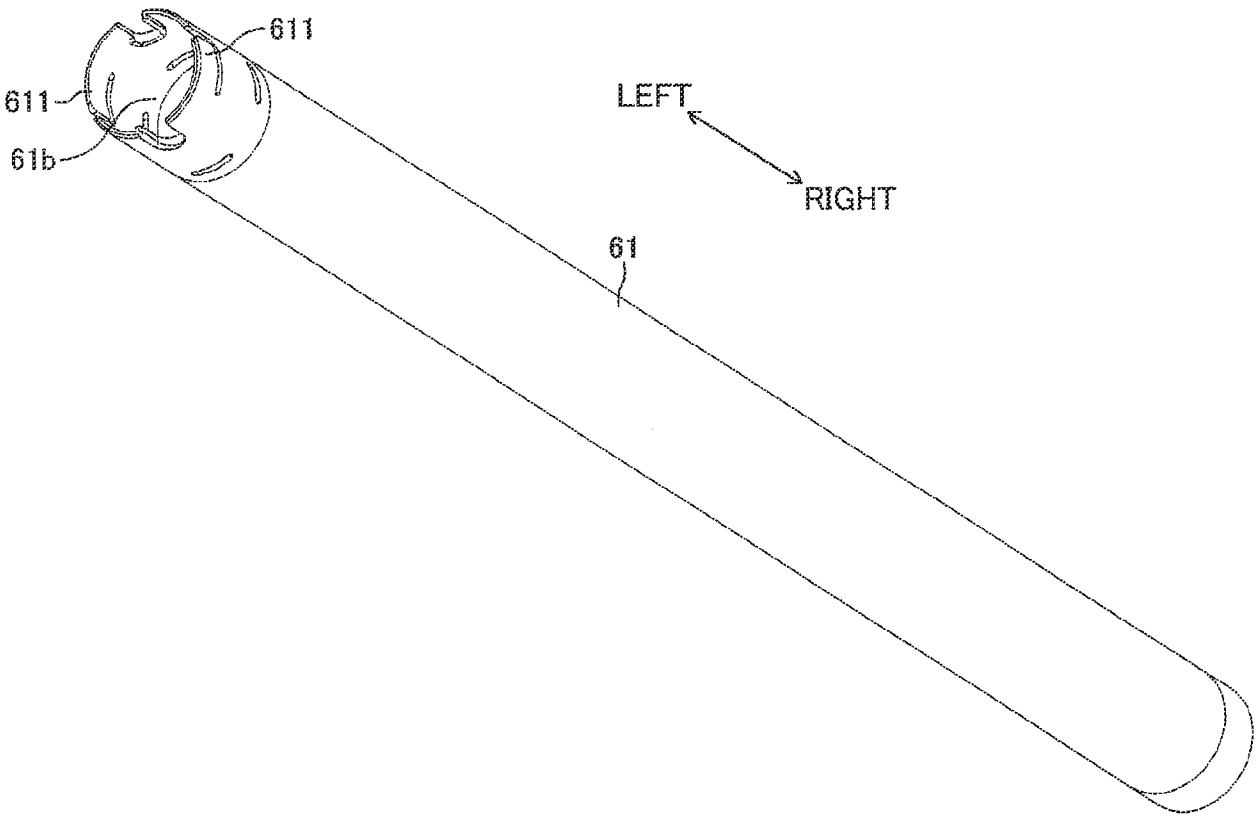
FIG. 6 is a perspective view of the heating roller body as shown in FIG. 5.
Figure 9A:
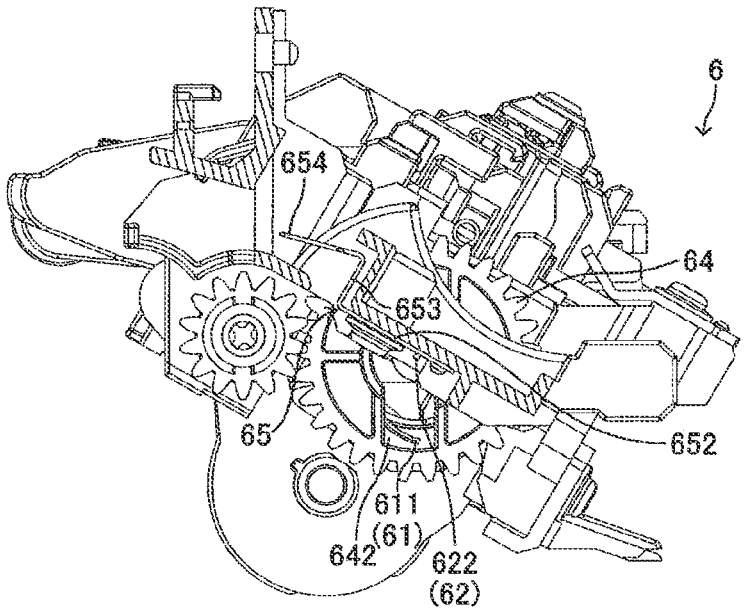
FIG. 9A is partial cross-sectional views of the fixing unit shown in FIG. 2 as viewed from a drive gear side, in which a faston terminal connector of a cable is not provided.
Figure 9B:
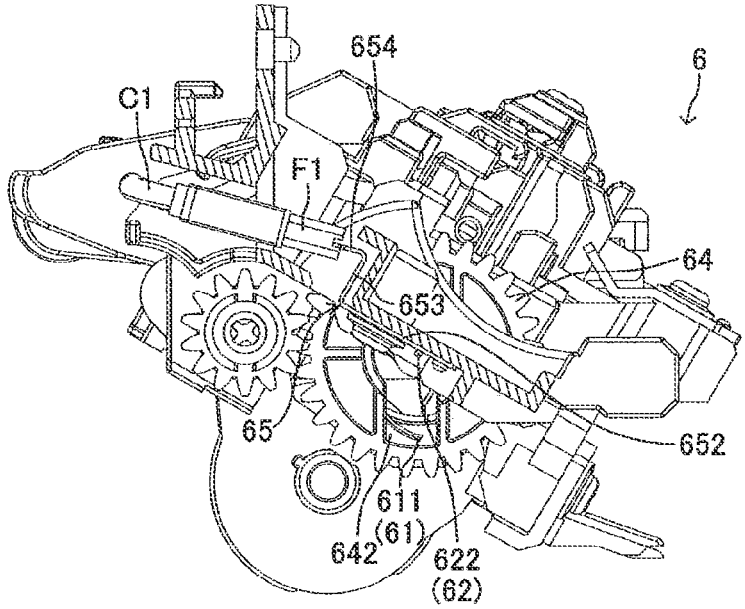
FIG. 9B is partial cross-sectional views of the fixing unit shown in FIG. 2 as viewed from the drive gear side in which an engaging terminal portion is inserted into the faston terminal connector of the cable.
Figure 10A:
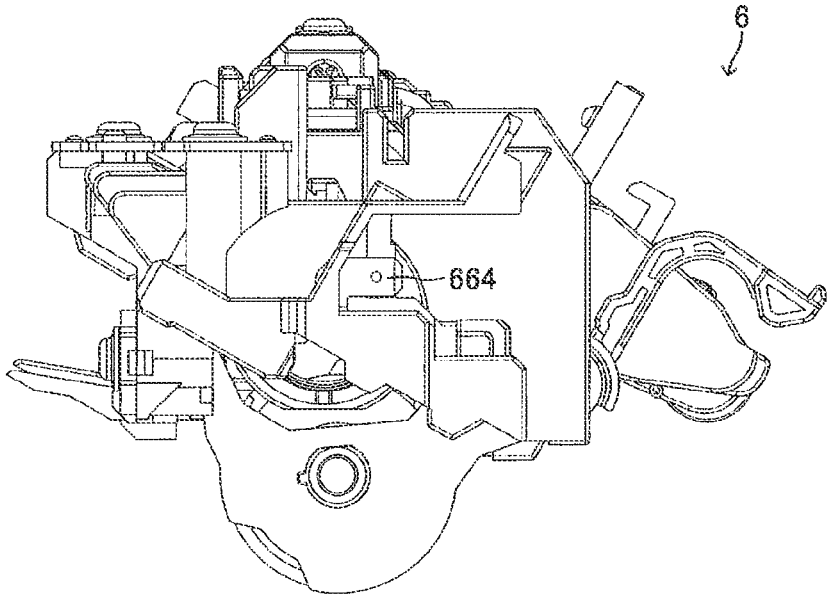
FIG. 10A is side views of the fixing unit shown in FIG. 2 as viewed from a side opposite to the drive gear side, in which a faston terminal connector of a cable is not provided.
Figure 10B:
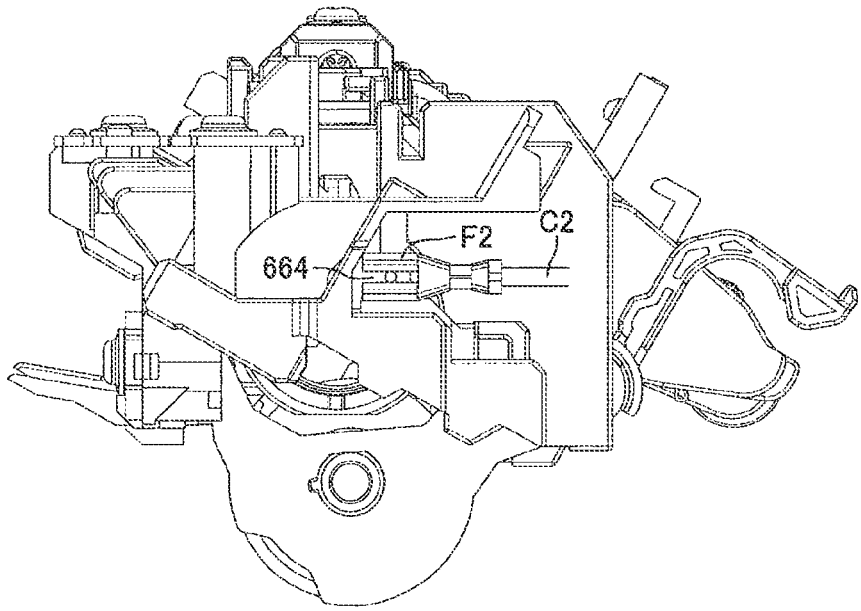
FIG. 10B is side views of the fixing unit shown in FIG. 2 as viewed from a side opposite to the drive gear side, in which an engaging terminal portion is inserted into the faston terminal connector of the cable.

As shown in FIGS. 5 and 6, the widthwise open end (left end) of the heating roller body 61 to which the driven gear 64 is fixed has a pair of tongued-shaped portions 611. The tongued-shaped portions 611 confront each other in a radial direction of the heating roller body 61. Each of the tongued-shaped portions 611 is provided along a circumferential direction of the heating roller body 61. The tongued-shaped portion 611 is bent outward in the radial direction so as to be engaged with the driven gear 64 (FIGS. 9A and 9B).

As shown in FIG. 5, the heater 62 includes a heating body 621 made of quarts glass and a filament disposed at an internal space of the heating body 621. Halogen gas is sealed in the heating body 621. The heating body 621 has a tip portion 621*a* formed when sealing the halogen gas in the heating body 621. The tip portion 621*a* is disposed at a position between widthwise end portions of the heating body 621, and protrudes radially outwardly from the heating body 621. The heater 62 has power supply terminals 622 and 623 that are fixed to the widthwise end portions of the heater 62, respectively. The power supply terminals 622 and 623 are metal wires. Each of the power supply terminals 622 and 623 extends in parallel with the sheet width direction so as to protrude outward from each of the widthwise end portion of the heating body 621.

The driven gear 64 is formed with a center hole 641 and a pair of reception holes 642. The center hole 641 and the reception holes 642 extend through the driven gear 64 in a thickness direction of the driven gear 64 (an axial direction of the driven gear 64). The center hole 641 is a through hole formed in a disk shape having an inner diameter greater than an outer diameter of the heating body 621 so as to allow the heating body 621 to pass therethrough. The center hole 641 is located at a position corresponding to an axis of the heating roller body 61 and the driven gear 64. Each of the reception holes 642 is located at a position displaced from the axis of the driven gear 64. The reception hole 642 accommodates the tongued-shaped portion 611 bent radially outwardly from the heating roller body 61, so that the tongued-shaped portion 611 is engaged with the reception hole 642. The reception hole 642 is in communication with the center hole 641 so as to form a single opening in cooperation with the center hole 641. That is, each of the reception holes 642 is formed so as to extend radially outward from the center hole 641.

Figure 7:
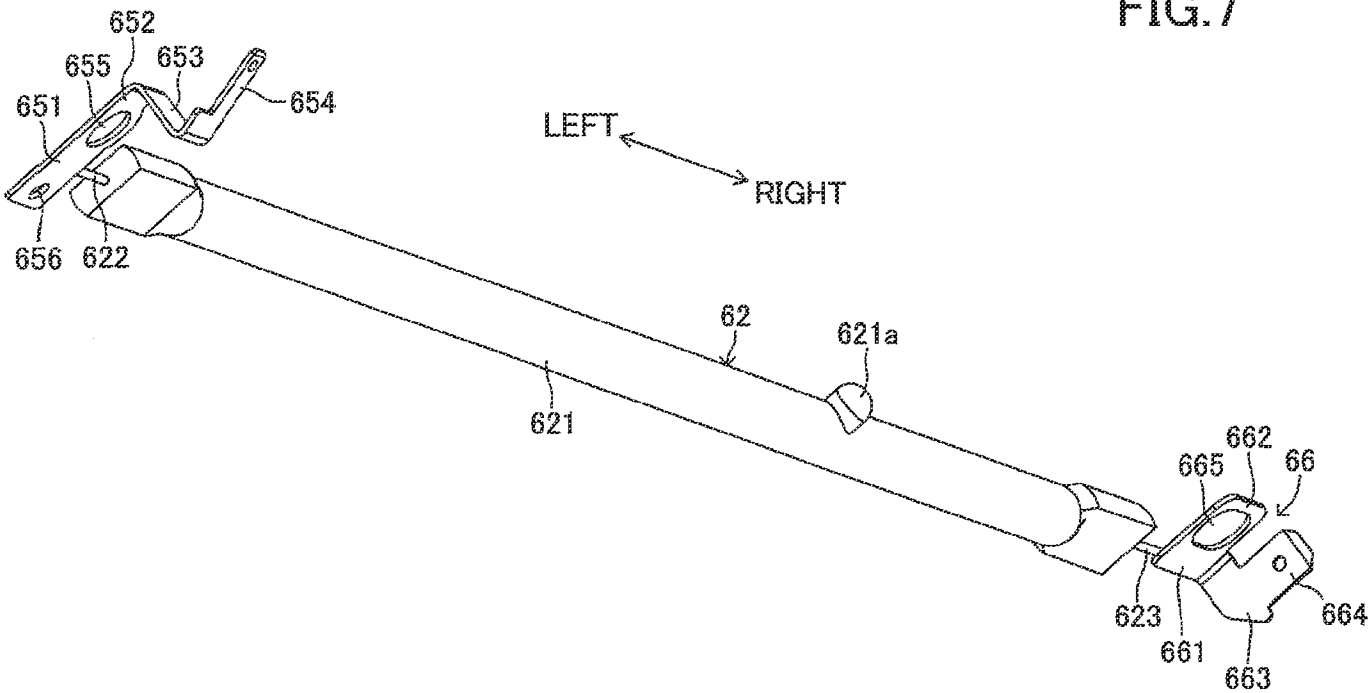
FIG. 7 is an enlarged perspective view of the heater as shown in FIG. 5.

As shown in FIGS. 5 and 7, the first terminal plate 65 is formed of a metal plate bent into a crank shape (generally Z-shape or N-shape). The first terminal plate 65 supports the heater 62 to be fixed to the fixing frame 60. Further, the first terminal plate 65 is fixed to the power supply terminal 622 to supply electric power to the heater 62. More specifically, the first terminal plate 65 includes an attached portion 651, a fixing portion 652, a connecting portion 653, and an engaging terminal portion 654. The attached portion 651 is a plate member arranged parallel to a longitudinal direction of the heater 62 and the radial direction of the heating roller body 61. The attached portion 651 is fixed to the power supply terminal 622 of the heater 62 by soldering.

Figure 8:
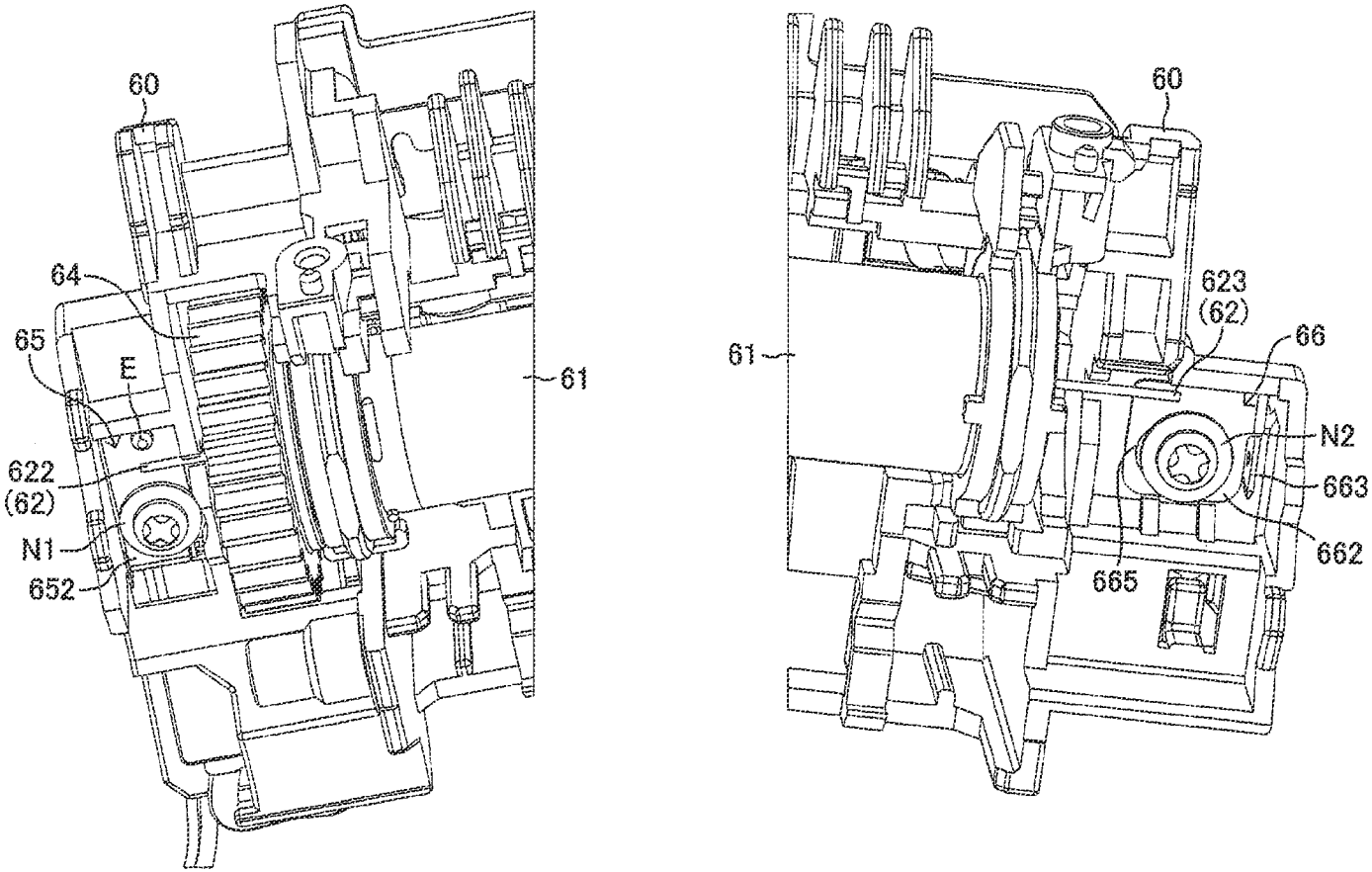
FIG. 8 is enlarged perspective views of widthwise end portions of the fixing unit as shown in FIG. 4.

The fixing portion 652 is a plate member arranged in parallel with and in flush with the attached portion 651. Further, the fixing portion 652 extends outward from both ends of the attached portion 651 in the radial direction of the heating roller body 61 and in parallel with the attached portion 651. The fixing portion 652 is formed with a circular fixing through hole 655 and an embossed through hole 656. As shown in FIGS. 7 and 8, the fixing through hole 655 is formed so as to allow the first screw N1 with a flange to pass therethrough. The embossed through hole 656 is formed such that an emboss E provided at a widthwise end portion of the fixing frame 60 penetrates through the embossed through hole 656. When the first screw N1 is fastened in a state that the emboss E penetrates through the embossed through hole 656 and the first screw N1 passes through the fixing through hole 655, the fixing portion 652 can be fixed to the fixing frame 60. That is, in this state, the fixing portion 652 is not movable relative to the fixing frame 60.

As shown in FIGS. 5 and 7, the connecting portion 653 is bent from an edge portion of the fixing portion 652 in an extending direction of the fixing portion 652 at a substantially right angle along the circumferential direction of the heating roller body 61. The engaging terminal portion 654 connects with the fixing portion 652 via the connecting portion 653. The engaging terminal portion 654 extends in the extending direction from an edge portion of the connecting portion 653 positioned farther from the fixing portion 652.

As shown in FIGS. 7 to 9B, the engaging terminal portion 654 is formed in a tongue-like shape. The engaging terminal portion 654 is inserted into a faston terminal connector F1 (FIG. 9B) connected to an end portion of a cable C1 (FIG. 9B) for supplying electric power to the heater 62 so as to be resiliently engaged with the faston terminal connector F1. Hence, the engaging terminal portion 654 is electrically connected to the cable C1. Further, as shown in FIG. 9B, a force is applied to the engaging terminal portion 654 when the faston terminal connector F1 is engaged with the engaging terminal portion 654. Both edge portions of the connecting portion 653 are resiliently deformable when the force is applied to the engaging terminal portion 654, so that the force is not transmitted to portions of the fixing frame 60 and the fixing portion 652 at which the first screw N1 is fastened.

As shown in FIGS. 5 and 7, the second terminal plate 66 as a terminal plate of the present embodiment is formed of a metal plate bent into a generally L-shape. The second terminal plate 66 supports the heater 62 to be fixed to the fixing frame 60. Further, the first terminal plate 65 is fixed to the power supply terminal 623 to supply electric power to the heater 62. More specifically, the second terminal plate 66 includes an attached portion 661, an engaging portion 662, a bent portion 663, and an engaging terminal portion 664.

The attached portion 661 is a plate member arranged in parallel with the longitudinal direction of the heater 62 and the radial direction of the heating roller body 61. The attached portion 661 is fixed to the power supply terminal 623 of the heater 62 by soldering. In the present embodiment, the attached portion 661 is arranged in parallel with and in flush with the attached portion 651 of the first terminal plate 65.

The engaging portion 662 is a plate and tongue-like shape member arranged in parallel with and in flush with the attached portion 661. Further, the engaging portion 662 extends outwardly in the radial direction of the heating roller body 61 from the attached portion 661. That is, the engaging portion 662 is arranged in parallel with the longitudinal direction of the heater 62 and the radial direction of the heating roller body 61. In the present embodiment, the engaging portion 662 extends in a direction the same as a protruding direction of the tip portion 621*a*. Hence, when viewed from the right side of the heater 62, the engaging portion 662 is overlapped with the tip portion 621*a*.

The engaging portion 662 is formed with an engaging hole 665. The engaging hole 665 is a through-hole having an oval shape whose longitudinal direction is parallel to the longitudinal direction of the heater 62. As shown in FIGS. 7 and 8, the engaging hole 665 is formed so as to allow the second screw N2 with a flange to pass therethrough. When the second screw N2 is inserted into the engaging hole 665, the engaging portion 662 is fixed to the fixing frame 60. In association with slight movement of the power supply terminal 623 in the sheet width direction (i.e. the longitudinal direction of the heater 62) due to thermal expansion, the engaging portion 662 is movably engaged with the fixing frame 60 in the sheet width direction.

As shown in FIGS. 5 and 7, the bent portion 663 is bent at a substantially right angle from an outermost edge of the attached portion 661 in the sheet width direction (an edge positioned farthest from the power supply terminal 623). That is, the bent portion 663 extends in a direction perpendicular to the sheet width direction (i.e. the longitudinal direction of the heater 62). In the present embodiment, the bent portion 663 is arranged so as to extend in a direction the same as an extending direction of the connecting portion 653 of the first terminal plate 65.

The engaging terminal portion 664 is a plate and tongue-like shape member arranged in parallel with and in flush with the bent portion 663. The engaging terminal portion 664 is integral of the bent portion 663, and connected to the outermost edge of the attached portion 661 via the bent portion 663. That is, the bent portion 663 and the engaging terminal portion 664 are bent at the outermost edge of the attached portion 661 in a direction perpendicular to the extending direction of the engaging portion 662 and the sheet width direction. Thus, the bent portion 663 and the engaging terminal portion 664 extend perpendicular to the longitudinal direction of the heater 62.

The engaging terminal portion 664 extends from the attached portion 661 and the bent portion 663 in a direction the same as the extending direction of the engaging portion 662. That is, the engaging terminal portion 664 extends in a direction the same as the protruding direction of the tip portion 621*a*. Further, the engaging terminal portion 664 protrudes from the bent portion 663 in a direction substantially the same as a protruding direction of the engaging terminal portion 654 from the connecting portion 653. As shown in FIGS. 9A to 10B, the engaging terminal portion 664 is inserted into a faston terminal connector F2 (FIG. 10B) connected to an end portion of a cable C2 for supplying electric power to the heater 62, in the same manner as the engaging terminal portion 654 of the first terminal plate 65, and resiliently engaged with the faston terminal connector F2. Hence, the engaging terminal portion 664 is electrically connected to the cable C2.

<Advantages and Effects>

The fixing unit 6 according to the above described embodiment provides the following advantages and effects:

In the fixing unit 6 according to the present embodiment, the engaging portion 662 of the second terminal plate 66 is arranged in parallel with the longitudinal direction of the heater 62, whereas the engaging terminal portion 664 intersects with the longitudinal direction of the heater 62. In the present embodiment, a surface of the engaging terminal portion 664 is perpendicular to the longitudinal direction of the heater 62. Further, the engaging portion 662 extends from the attached portion 661 in a direction the same as a direction in which the engaging terminal portion 664 extends from the attached portion 661. More specifically, the engaging portion 662 is arranged in parallel with and in flush with the attached portion 661. The engaging terminal portion 664 is connected to the outermost edge of the attached portion 661 and bent at the outermost edge in a direction perpendicular to the extending direction of the engaging portion 662 and the sheet width direction. Further, the engaging portion 662 and the engaging terminal portion 664 extend in a direction the same as the protruding direction of the tip portion 621*a*. The engaging portion 662 is overlapped with the tip portion 621*a* when viewed in a direction parallel to the longitudinal direction of the heater 62.

With this configuration, a protruding amount of the second terminal plate 66 (the engaging portion 662 and the engaging terminal portion 664) from the power supply terminal 623 of the heater 62 in the longitudinal direction (i.e. the sheet width direction) and the radial direction of the heater 62 can be reduced as much as possible. As a result, when the heater 62 is inserted into the heating roller body 61 to which the driven gear 64 is assembled, the second terminal plate 66 can easily pass through the through hole (the center hole 641 and a pair of the reception holes 642) formed in the driven gear 64 and the widthwise open ends of the heating roller body 61. Further, protrusion of the tip portion 621*a* from the heater 62 can fall within a protruding length of the second terminal plate 66 (the engaging portion 662) from the power supply terminal 623. This prevents the tip portion 621*a* from impinging on an inner peripheral edge of the through hole formed in the driven gear 64. Accordingly, degradation of workability when inserting the heater 62 into the heating roller body 61 can be successfully avoided.

With this configuration, when the heater 62 is inserted into the heating roller body 61 to which the driven gear 64 is assembled, such an assembling procedure can be reliably and easily performed. Even if the heating roller body 61 has a reduced diameter, the heater 62 to which the second terminal plate 66 is attached can be inserted into the heating roller body 61 through the through hole formed in the driven gear 64. This realizes the heating roller body 61 having a reduced diameter without complexing or complicating the assembling procedure.

In the fixing unit 6 according to the present embodiment, the power supply terminal 622 of the heater 62 is attached (fixed) to the attached portion 651 and the power supply terminal 623 is attached (fixed) to the attached portion 661 of the second terminal plate 66. The fixing portion 652 of the first terminal plate 65 is fixed to one of the widthwise end portions of the fixing frame 60 and the engaging portion 662, that is formed with the engaging hole 665 having the oval shape, of the second terminal plate 66 is engaged with remaining one of the widthwise end portions of the fixing frame 60. Accordingly, the second terminal plate 66 is movably engaged with the fixing frame 60 in response to slight change in a distance in the sheet width direction (the longitudinal direction of the heater 62) between the power supply terminal 622 and the power supply terminal 623 in association with the thermal expansion of the heater 62, and the heater 62 is fixedly supported to the fixing frame 60.

When the heater 62 has been fixedly supported to the fixing frame 60 via the first terminal plate 65 and the second terminal plate 66, the engaging terminal portion 654 of the first terminal plate 65 is resiliently engaged with the faston terminal connector F1 and the engaging terminal portion 664 of the second terminal plate 66 is resiliently engaged with the faston terminal connector F2. As a result, the heater 62 is easily and reliably connected to the above described power supply circuit.

As described above, the heater 62 can be stably supported to the fixing unit 6 and power supply to the heater 62 can be easily and reliably attained. Further, the parts and components of the fixing unit 6 can be downsized.

<Modifications>

While the invention has been described in detail with reference to specific embodiments thereof, it would be apparent to those skilled in the art that many modifications and variations may be made therein without departing from the spirit of the invention, the scope of which is defined by the attached claims.

For example, in the above described embodiment, the image forming device is the monochromatic laser printer. However, a color laser printer, an electrophotographic type image forming device such as a monochromatic copying machine and a color copying machine, and an image forming device other than the electrophotographic type without a photosensitive member, such as a toner jet type image forming device, an ion flow type image forming device, and a multi stylus electrode type image forming device, are also available. In a case of the electrophotographic type printer, instead of the photosensitive drum 32, a flat plate type or an endless belt type of photosensitive member is available.

In the above described embodiment, the power supply terminals 622 and 623 of the heater 62 is fixed to the attached portions 651 and 661 by soldering, respectively. However, the power supply terminals 622 and 623 of the heater 62 can be fixed to the attached portions 651 and 661 by other methods, respectively. Further, the engaging portion 662 can be arranged not in flush with the attached portion 661. Further, the angle defined between the attached portion 661 (the engaging portion 662) and the engaging terminal portion 664 is not required to be a substantially right angle. In other words, the engaging terminal portion 664 is not required to be perpendicular to the longitudinal direction of the heater 62.

What is claimed is:

1. A fixing device comprising:

a heating roller body that is a cylindrical member configured to rotate about a first axis and extending in a first axial direction, the heating roller body being formed with a roller through-hole extending in the first axial direction;

a heater insertable into the roller through-hole and configured to generate heat, the heater extending in a longitudinal direction in parallel with the first axial direction and having one end in the longitudinal direction;

a power supply terminal fixed to the one end;

a terminal plate attached to the power supply terminal and configured to supply electric power to the heater; and a fixing frame configured to rotatably support the heating roller body and to fixedly support the heater, and wherein the terminal plate comprises:

an attached portion attached to the power supply terminal;

an engaging portion that is a plate member extending from the attached portion in a first radial direction of the heating roller body and arranged in parallel with the longitudinal direction, the engaging portion being engaged with the fixing frame; and an engaging terminal portion that is a plate member connected to the attached portion and extending in a second radial direction of the heating roller body, the engaging terminal portion intersecting with an imaginary line extending along the longitudinal direction of the heater and passing through the heater, the second radial direction being a same direction as the first radial direction, the engaging terminal portion being inserted into a connector connected to an end portion of a cable for supplying the electric power to the heater.

2. The fixing device according to claim 1, wherein the engaging portion is arranged in parallel with and flush with the attached portion, the attached portion having an outermost edge in the longitudinal direction, and wherein the engaging terminal portion is connected to the outermost edge and bent at the outermost edge in a direction perpendicular to the first radial direction and the longitudinal direction such that the engaging terminal portion intersects with the imaginary line extending along the longitudinal direction of the heater and passing through the heater.

3. The fixing device according to claim 1, wherein the heater includes a glass tube sealing a gas and is formed with a tip portion formed when sealing the gas in the glass tube, the tip portion protruding in the first radial direction of the heating roller body.

4. The fixing device according to claim 3, wherein the engaging portion is overlapped with the tip portion when viewed from a side of the heater in the longitudinal direction.

5. The fixing device according to claim 1, further comprising a driven gear that is configured to rotate about a second axis and defining a second axial direction, wherein the heating roller body has one end portion in the longitudinal direction, the driven gear being fixed to the one end portion, the one end portion having an engaging plate bent outwardly in a third radial direction of the heating roller body so as to be engaged with the driven gear, wherein the driven gear is formed with a through hole including a reception hole and a center hole, the reception hole being located at a position displaced from the second axis and accommodating the engaging plate bent outwardly in the third radial direction such that the engaging plate is engaged with the reception hole, the center hole being located at a position corresponding to the second axis to allow the heater to pass therethrough, the reception hole and the center hole being in communication with each other and extending through the driven gear in the second axial direction of the driven gear.

6. The fixing device according to claim 1, wherein a dimension of the engaging terminal portion along the second radial direction of the heating roller body is greater than a dimension of the engaging portion along the longitudinal direction of the heater.

* * * * *